United States Patent [19]

Engibarov

[11] Patent Number: 5,060,920

[45] Date of Patent: Oct. 29, 1991

[54] QUICK CHANGE JAW ASSEMBLY FOR HIGH PRECISION MACHINING

[76] Inventor: Eddy Engibarov, c/o E.Z.E. Machine Company 616 Onderdonk Ave., Ridgewood, N.Y. 11385

[21] Appl. No.: 630,540

[22] Filed: Dec. 20, 1990

[51] Int. Cl.[5] ..... B25B 1/24

[52] U.S. Cl. ..... 269/282

[58] Field of Search ..... 269/279–284; 81/421, 423

[56] References Cited

U.S. PATENT DOCUMENTS

| | | | |
|---|---|---|---|
| 713,189 | 11/1902 | Yates | 269/283 |
| 2,492,558 | 12/1949 | Deubler | 269/282 |
| 2,838,971 | 6/1958 | Shekter | 269/279 |
| 4,251,066 | 2/1981 | Bowling | 269/283 |
| 4,798,371 | 1/1989 | Wallisser | 269/283 |
| 4,923,186 | 5/1990 | Durfee | 269/282 |

*Primary Examiner*—Robert C. Watson

*Attorney, Agent. or Firm*—Helfgott & Karas

[57] ABSTRACT

A movable jaw assembly of a workpiece holder mounted on a high-precision machining table is disclosed that has a gripping surface that can be rapidly changed without loosening the interfaces between the jaw and the shaft of the assembly or the base of the assembly and the table. The quick-change gripping surface is provided on a moveable jaw assembly having a dovetail-shaped foot and is removably received in a channel on the jaw assembly. A right-circular conical set screw presses an angled surface of the foot against an angled lower side of the channel. The upper side of the channel is cutaway to permit the foot to pivot out of the channel. The jaw is located in the channel by an index groove on the rear surface of the jaw that fits over an index pin in the channel.

23 Claims, 3 Drawing Sheets

QUICK CHANGE JAW ASSEMBLY FOR HIGH PRECISION MACHINING

BACKGROUND OF THE INVENTION

1. Field of the Invention

The invention relates to vises and, more particularly, to workpiece holders used to precisely position and reliably secure workpieces during machining operations such as milling, grinding, drilling and tapping, and which can be quickly changed from one set to another.

2. Discussion of Related Art

The jaws of high-precision workpiece holders are usually made of hardened steel and have precisely-machined gripping surfaces that are designed to exert great force on a workpiece, relative to its size. It is important that this great clamping force be applied as uniformly as possible to the workpiece, so that sidewise, lengthwise and vertical deflection of the workpiece during the machining operation is prevented.

High-precision workpiece holders may be free-standing, portable jigs that are adaptable for multiple uses. Alternatively, they may be designed to be assembled on, or otherwise integral with, the machining table of a particular machine tool.

Machining tables typically have a hardened-steel upper surface that contains a plurality of spaced, parallel channels. The cross section of these channels, conventionally called T-slots, has an inverted "T" shape. The workpieces are held by jaw assemblies mounted on the table. Moveable jaw assemblies each have a foot that is inserted into a respective T-slot. Each such assembly is then slid along a T-slot until it reaches the proper position on the table. The jaw assembly is then locked in position on the table.

Workpieces are customarily placed against a fixed jaw on the machining table. The moveable jaw is then pressed against the workpiece, to clamp it in position. The moveable jaw assembly comprises a flat, relatively heavy base that is attached to the T-shaped foot on the jaw assembly. This base houses a rotatable, helically threaded shaft. Rotation of the shaft causes displacement of the moveable jaw toward and away from the fixed jaw. The fixed jaw assembly is either locked in place on the machining table, or integral with the table.

The clamping force that each moveable jaw can provide depends upon the strength of the lock that secures the jaw assembly, the precision and ruggedness of the helical threads and grooves in the moveable jaw assembly and the tightness of the fit between the jaw and the base of the jaw assembly, particularly between the shaft and the base of the moveable jaw assembly. The effective clamping force of the workpiece holder is reduced whenever the jaw is deflected relative to the base or the base is deflected relative to the table. This decrease in effective clamping force compromises the accuracy and reliability of the workpiece holder. The degree of deflection increases with wear, which causes looseness between the threads of the shaft and the corresponding grooves in the base, and between the jaw and the base.

However, it is desirable to increase the stability of the workpieces in the jaws of the workpiece holder by using gripping surfaces that conform to the surface of particular workpieces. Unlike the gripping surfaces of a simple vise, which have planar gripping surfaces that merely lie in a plane normal to the movement of the jaw, these conforming gripping surfaces must be precisely aligned relative to the machine tool within that plane, so as to prevent mislocation of the workpiece.

To save time and avoid excessive wear on the surfaces of the base and jaw that contact the shaft, jaws are customarily changed by removing an entire jaw assembly from the jig or machine table. That jaw assembly is then replaced with an assembly having the required jaw shape. However, replacing the entire jaw assembly requires a costly inventory of heavy, bulky jaw assemblies. Also, fitting the entire assembly into the T-slot, sliding it into position, and locking it in place is a time-consuming procedure that increases the risk of lock failure through wear or through operator error.

SUMMARY OF THE INVENTION

Accordingly, it is an object of the present invention to provide an adaptable jaw assembly that permits a quick change of the jaw's gripping surface.

Another object of the present invention is to provide an adaptable jaw assembly to obviate the need for an expensive inventory of jaw assemblies.

Another object of the present invention is to provide an adaptable jaw assembly that provides a precise and stable orientation of the jaw's gripping surface, to prevent mislocation of the workpiece.

A further object of the invention is to provide a quick-change jaw that does not contribute to wear and looseness within the jaw assembly.

A further object of the invention is to provide a quick-change jaw assembly that does not contribute to the risk of lock failure within the workpiece holder.

A still further object is to provide a jaw that can be readily changed within a confined space.

These and other objects of the invention are achieved by apparatus in accordance with the present invention, wherein the gripping surface on a jaw assembly is provided on are movable jaw having a foot on the side opposite to the jaw's gripping surface. The jaw is adapted to be fitted into a channel on the jaw assembly. The jaw assembly is adapted to be secured to a plate. The side of the channel opposite to the plate is cutaway so as to permit the removable jaw to pivot out of the channel.

The foot of the removable jaw is provided with an indentation adapted to receive an index tab located on the jaw assembly, to precisely locate the jaw in the channel. The foot is secured in the channel by a set screw having a right-circular conical point. The foot has two angled surfaces. The set screw presses against a first angled surface on the foot. The pressure provided by the set screw forces the foot against an angled surface on the jaw assembly that is complementary to a second, angled surface on the foot. The two angled surfaces of the foot form equal angles with the axis of the set screw to force the jaw against bearing surfaces on the jaw assembly that are parallel to the setscrew.

In a particular embodiment, the indentation is adapted to slidingly receive the tab as the foot is pivoted into the channel. One edge of the angled surface of the channel and one edge of the jaw are bevelled, so as to provide clearance for pivoting the jaw into and out of the channel while the jaw assembly is secured to a plate.

BRIEF DESCRIPTION OF THE DRAWINGS

The features and advantages of the present invention will be better understood when the detailed description of a preferred embodiment that is given below is considered in conjunction with the drawings provided, wherein.

DETAILED DESCRIPTION OF A PREFERRED EMBODIMENT

Figure 1:
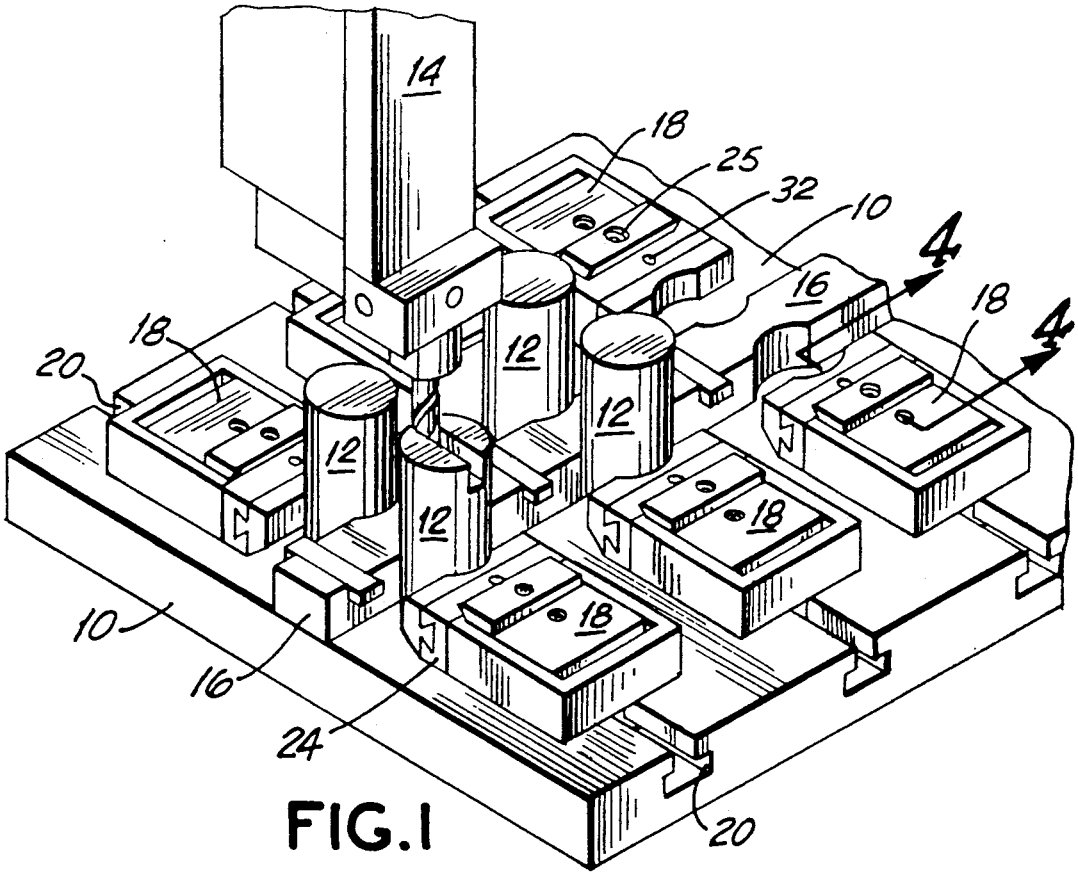
FIG. 1 is a perspective view of a machining table having jaw assemblies in accordance with the present invention secured thereto.

FIG. 1 shows a routing machine having a machining table 10 on which a number of workpieces 12 are placed to be cut by the tool head 14. Each workpiece 12 is held between a fixed jaw assembly 16 and one of the moveable jaw assemblies 18 that are each secured by a T-shaped foot 19 in a respective T-slot 20 of the machining table 10. Each moveable jaw assembly 18 has a removable jaw 22, and a jaw holder 24 attached thereto. The jaw 22 and jaw holder 24 are moved by helically-threaded vertical shaft 25. The jaw 22 has a dovetail-shaped foot 26 opposite to its gripping surface 28. The gripping surface 28 of the jaw 22 shown in FIGS. 1 and 2 has a cutaway portion 29 that conforms to the side surface of the right-circular cylindrical workpieces 12 shown in FIG. 1.

Figure 4:
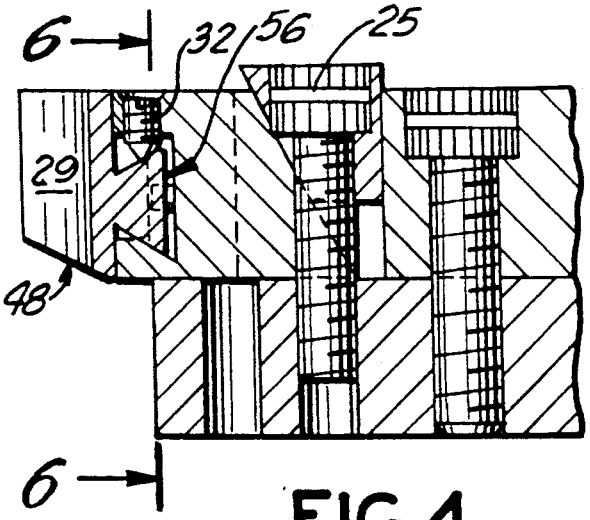
FIG. 4 is a cross section view along section line 4, as shown in FIG. 1.
Figure 6:
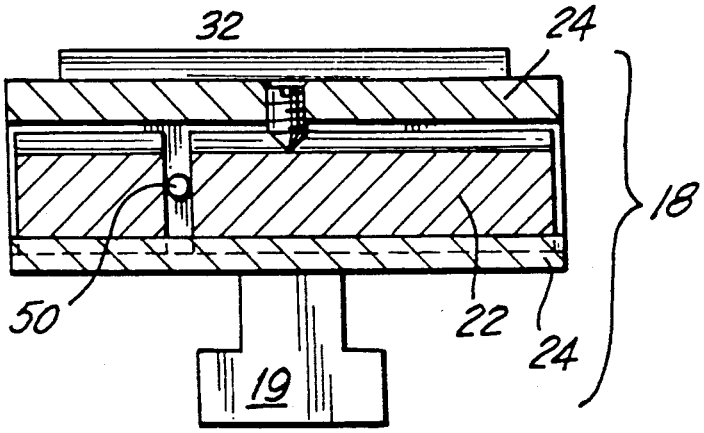
FIG. 6 is a cross section view along section line 6, as shown in FIG. 4.

The foot 26 of the jaw 22 is held in a specially-shaped channel 30 by a set screw 32 having a right-circular conical point 34. The set screw 32 when it is screwed in against the angled surface 36, pulls the jaw 22 in tight against the jaw holder 24. By using only slight turning of the screw, a very tight clamping effect is thus achieved. Tightening the set screw 32 forces the lower angled surface 38 of the foot 26 against the complementary angled surface of the lower side 40 of the channel 30. The downward force provided by the set screw 32 is, thus, partially redirected by these angled surfaces 36, 38, 40 against the two bearing surfaces 42, 43 of the jaw holder 24, as can be see in the cross sections of FIGS. 4 and 6.

Furthermore, because the angled surfaces 36, 38 of the foot 26 form a truncated isosceles triangle having a base 44 parallel to the planes defined by the bearing surfaces 42, 43 of the jaw holder 24, the jaw is pressed evenly against the two bearing surfaces by the set screw. This even transfer of the downward force of the set screw 32 to the two bearing surfaces 42, 43, positively assures that the jaw 22 is properly seated, so that the clamping force applied by the jaw 22 of the moveable jaw assembly 18 to the workpiece 12 is fully supported by those two bearing surfaces.

Although the lower side 40 of the channel 30 is angled so as to support the lower angled surface 38 of the dovetail-shaped foot 26 of the jaw 22, the upper side 46 of the channel 30 and the edge 47 between the lower bearing surface 43 and the channel 30 are cutaway. The upper side 46 of the channel 30 is cut as a plane normal to the rear surface 52 of the channel 30 that is parallel to the bearing surfaces 42, 43, but does not contact the foot 26. The edge 47 between the lower bearing surface 43 and the lower angled side 40 of the channel 30 is bevelled, forming a plane parallel to the upperside 46 of the channel 30.

Figure 5:
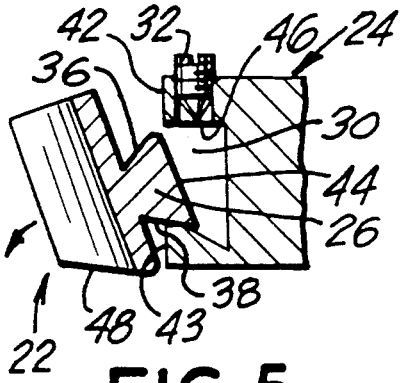
FIG. 5 is a partial cross section view as in FIG. 4, and showing the removal of the jaw.

These cutaway portions 46, 47 of the channel 30 permit the jaw 22 to pivot freely out of the channel 30 about the bevelled edge 47 in the direction of the fixed jaw assembly 16 when the set screw 32 is backed away from the foot 26 of the removable jaw 22, as best seen in FIG. 5. This pivoting movement permits the removable jaw 22 to be rapidly changed while the moveable jaw assembly 18 is still attached to the machining table 10 proximate to the fixed jaw assembly 16. The bevelled lower edge 48 of the jaw 22 provides clearance between the jaw 22 and the machining table 10 as the foot 26 of the jaw 22 pivots out of the channel 30. The flat top portion 46 of the channel 52 permits the top of the foot 26 to pivot out of the channel 30.

Figure 2:
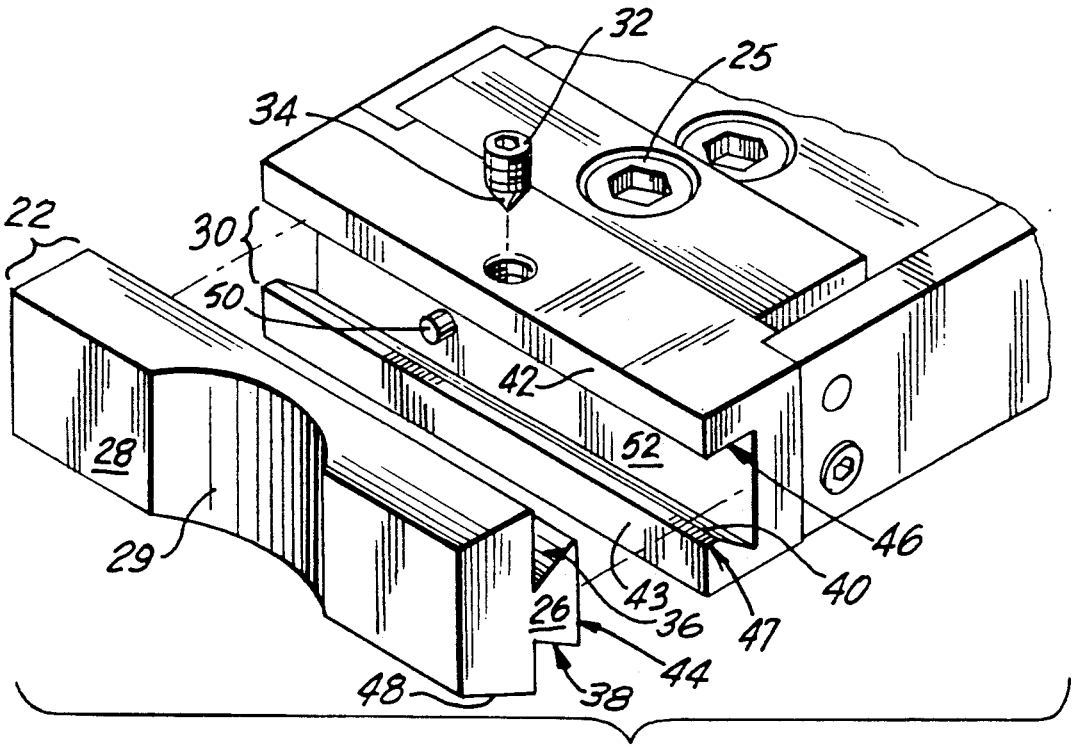
FIG. 2 is an exploded view of the jaw and dovetail slot of the jaw assemblies of FIG. 1.

To assure that the cutaway portion 29 of the jaws 28 shown in FIGS. 1 and 2 is properly aligned with the surface of the respective workpiece 12 on the machining table 10, a right-cylindrical index pin 50 is affixed to the rear surface 52 of the channel 30 in each jaw assembly 18. This pin 50 cooperates with a rectilinear index groove 54 shown in FIG. 3. The groove 54 is machined in the rear surface 56 of the foot 26 of each jaw 22. The groove 54 is cut to be parallel to the axis of the set screw 32, so that the pin 50 slides along the groove 54 as the jaw 22 is pivoted into and out of the position in the channel 30, as can be seen in the cross sections in FIGS. 4 and 6.

Figure 3:
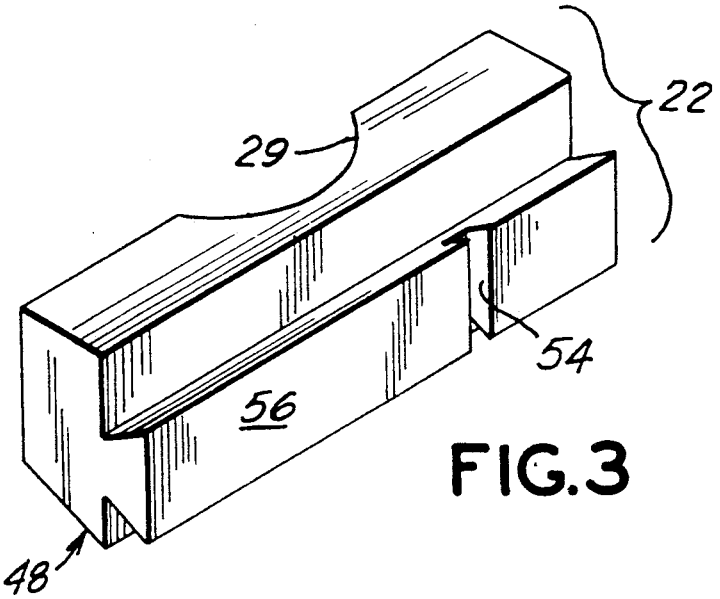
FIG. 3 is a perspective view of the indentation on the foot of the jaw of FIG. 2.
Figure 7:
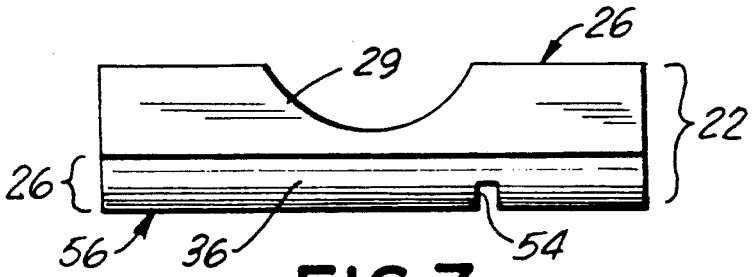
FIGS. 7 through 9 are top-down plan views of jaws having different gripping surfaces.
Figure 8:
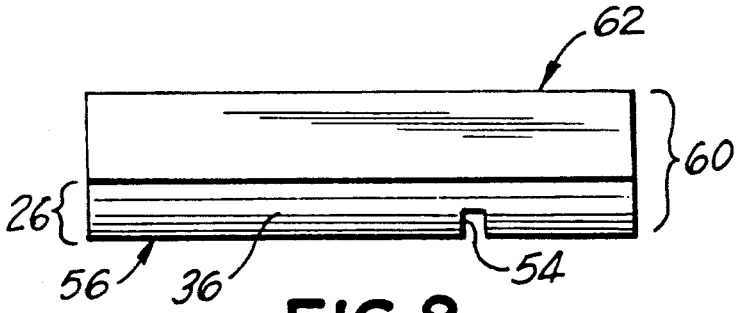
Figure 9:
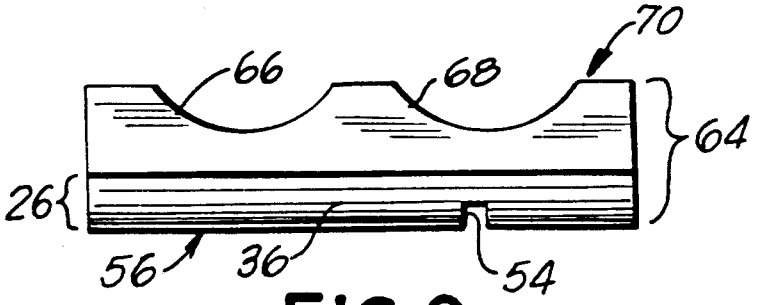

FIG. 7 is a top view of the removable jaw 26 shown in FIGS. 1 through 3, which has one cutaway portion 29. FIG. 8 is a top view of a jaw 60 having a simple, vise-like planar gripping surface 62. FIG. 9 is a top view of a jaw 64 having two cutaway portions 66, 68 in the gripping surface 70. It should be appreciated that other jaw surfaces could be used. In accordance with this invention, these jaws are relatively small, inexpensive parts that can be rapidly interchanged on a given jaw assembly. This change is affected without removing that jaw assembly and without moving the shaft in the base of the jaw assembly, so that deflection caused by excessive wear and operator error in relocking the jaw assembly are prevented. Furthermore, the foot of the jaw cooperates with the jaw assembly to positively seat the jaw against the bearing surfaces of the jaw assembly, to reliably transfer the clamping force provided by the shaft in the base of the jaw assembly.

The invention has been described with particular reference to a presently preferred embodiment of the invention. However, it will be apparent to one skilled in the art that variations and modifications of this embodiment are possible within the spirit and scope of this invention, which is defined by the appended claims. For example, a removable jaw in accordance with the present invention could be provided on a fixed jaw assembly of a portable jig.

I claim:

1. A workpiece holder having a jaw assembly adapted to be secured to a plate, said jaw assembly comprising:

a channel having opposing sides, one side being substantially horizontal and the other side being angled and facing said one side;

a removable jaw including a gripping surface adapted to apply a clamping force to a workpiece and a foot on a surface of the jaw opposite to said gripping surface, said foot being adapted to be received in said channel, said foot having an angled surface adapted to be pressed against said angled side of said channel;

means for releasably pressing said jaw against said angled side of the channel, whereby said removable jaw is releasably secured in said channel; and locating means, respectively provided on said jaw and a wall of said channel between said opposing sides thereof, and cooperating with each other so as to precisely locate the jaw in the channel of the jaw assembly.

2. The workpiece holder of claim 1 wherein said locating means comprise a tab, and a corresponding indentation, and wherein one of said jaw and said channel has an indentation adapted to receive said tab, so as to precisely locate the jaw in the channel of the jaw assembly.

3. The workpiece holder of claim 2 wherein said indentation is adapted to slidingly receive said tab as said foot is pivoted into said channel.

4. The workpiece holder of claim 1 wherein said lower edge of said channel is the angled surface, the edge thereof being bevelled so that pivoting of the removable jaw is facilitated.

5. The workpiece holder of claim 1 wherein the lower edge of said gripping surface is bevelled, whereby removal of the removable jaw while the jaw assembly is secured to the plate is facilitated.

6. A workpiece holder having a jaw assembly adapted to be secured to a plate, said jaw assembly comprising:

a channel having a cutaway first side opposite to the plate and an angled second side facing said first side;

a removable jaw including a gripping surface adapted to apply a clamping force to a workpiece, and a foot on a side of the jaw opposite to said gripping surface, said foot being adapted to be received in said channel, said foot having a first angled surface adapted to be pressed against said angled second side of said channel and a second angled surface;

a set screw adapted to releasably press said removable jaw against said angled second side of the channel, said second angled surface being contacted by said screw so that said foot is pressed into the channel when the set screw presses against said second angled surface, whereby said jaw is firmly seated on said jaw assembly; and locating means, respectively provided on said jaw and a wall of said channel between said facing sides thereof, and cooperating with each other so as to precisely locate the jaw in the channel of the jaw assembly.

7. A workpiece holder having jaw assembly adapted to be secured to a plate, said jaw assembly comprising:

a channel having a cutaway first side opposite to the plate and an angled second side facing said first side;

a removable jaw including a gripping surface adapted to apply a clamping force to a workpiece, and a foot on a side of the jaw opposite to said gripping surface, said foot being adapted to be received in said channel, said foot having a first angled surface adapted to be pressed against said angled second side of said channel and a second angled surface;

a set screw adapted to releasably press said jaw against said angled second side of the channel, said set screw having an axis of rotation, said first and second angled surfaces of the foot forming equal angles with said axis of rotation of said set screw;

two bearing surfaces adapted to support the clamping force of said removable jaw, whereby said removable jaw is pressed evenly against said two bearing surfaces of the jaw assembly; and locating means, respectively provided on said jaw and a wall of said channel between said facing sides thereof, and cooperating with each other so as to precisely locate the jaw in the channel of the jaw assembly.

8. A workpiece holder jaw assembly adapted to be secured to a plate, said jaw assembly comprising:

a channel having a cutaway first side opposite to the plate and an angled second side facing said first side;

a removable jaw including a gripping surface adapted to apply clamping force to the workpiece and a foot on a side of the jaw opposite to said gripping surface, said foot being adapted to be received in said channel, said foot having an angled surface adapted to be pressed against said angled second side of said channel;

means for releasably pressing said jaw against said angled second side of the channel, whereby said removable jaw is releasably secured in said channel; and locating means, respectively provided on said jaw and a wall of said channel between said facing sides thereof, and cooperating with each other so as to precisely locate the jaw in the channel of the jaw assembly.

9. The jaw assembly of claim 8, wherein said locating means comprise a tab and an indentation on said jaw adapted to receive said tab, so as to precisely locate the jaw in the channel of the jaw assembly.

10. The jaw assembly of claim 9 wherein said indentation is adapted to slidingly receive said tab as said foot is pivoted into said channel.

11. The jaw assembly of claim 8 wherein said lower edge of the channel is bevelled so that the pivoting of the removable jaw is facilitated.

12. The jaw assembly of claim 8 wherein the lower edge of said gripping surface is bevelled, whereby removal of the removable jaw while the jaw assembly is attached to the plate is facilitated.

13. A workpiece holder jaw assembly adapted to be secured to a plate, said jaw assembly comprising:

a channel having a horizontal cutaway first side opposite to the plate and an angled second side facing said first side;

a removable jaw including a gripping surface adapted to apply a clamping force to a workpiece, and a foot on a surface of the jaw opposite to said gripping surface, said foot being adapted to be received in said channel, said foot having a first angled surface adapted to be pressed against said angled second side of said channel and a second angled surface;

a set screw releasably pressing said jaw against said angled second side of the channel, said second angled surface being contacted by said set screw so that said foot is pressed into the channel when the set screw presses against said second angled surface, whereby said jaw is firmly seated on said jaw assembly; and locating means, respectively provided on said jaw and a wall of said channel between said facing sides thereof, and cooperating with each other so as to precisely locate the jaw in the channel of the jaw assembly.

14. A workpiece holder jaw assembly adapted to be secured to a plate, said jaw assembly comprising:

a channel having a cutaway first side opposite to the plate and an angled second side facing said first side;

a removable jaw including a gripping surface adapted to apply a clamping force to a workpiece, and a foot on a surface of the jaw opposite to said gripping surface, said foot being adapted to be received in said channel, said foot having a first angled surface adapted to be pressed against said angled second side of said channel and a second angled surface;

a set screw adapted to releasably press said jaw against said angled second side, said first and second angled surfaces of said foot forming equal angles with said axis of rotation of said set screw;

two bearing surfaces adapted to support the clamping force of said removable jaw, whereby said removable jaw is pressed evenly against said two bearing surfaces; and locating means, respectively provided on said jaw and a wall of said channel between said facing sides thereof, and cooperating with each other so as to precisely locate the jaw in the channel of the jaw assembly.

15. A removable jaw for a workpiece holder jaw assembly, said jaw assembly being adapted to be secured to a plate; said jaw assembly including the removable jaw; a channel having a horizontal cutaway first side opposite to the plate and an angled second side facing said first side; and means for releasably pressing said jaw against said angled second side; said removable jaw comprising:

a gripping surface adapted to apply clamping force to the workpiece;

a foot on a surface of the jaw opposite to said gripping surface, said foot being adapted to be received in the channel, said foot having an angled surface adapted to be pressed against said angled second side of the channel, whereby said removable jaw is releasably secured in the channel of the jaw assembly; and locating means, respectively provided on said jaw and a wall of said channel between said facing sides thereof, and cooperating with each other so as to precisely locate the jaw in the channel of the jaw assembly.

16. The removable jaw of claim 15, wherein said locating means comprise an indentation of said jaw adapted to receive a tab located on the jaw assembly, so as to precisely locate said jaw in the channel of the jaw assembly.

17. The removable jaw of claim 16 wherein said indentation is adapted to slidingly receive the tab as said foot is pivoted into the channel of the jaw assembly.

18. The removable jaw of claim 15 wherein the lower edge of said gripping surface is bevelled, whereby removal of said removable jaw while the jaw assembly is attached to the plate is facilitated.

19. A removable jaw for a workpiece holder jaw assembly adapted to be secured to a plate, said jaw assembly including the removable jaw; a channel with a horizontal cutaway first side opposite to the plate and an angled second side facing said first side; and a set screw, said removable jaw comprising:

a gripping surface adapted to apply clamping force to the workpiece;

a foot on a side of the jaw opposite to said gripping surface, said foot being adapted to be received in the channel, said foot having a first angled surface adapted to be pressed against said angled second side of said channel and a second angled surface adapted to be contacted by the set screw so that said foot is pressed into the channel when the set screw presses against said second angled surface, whereby said jaw is firmly seated on the jaw assembly; and locating means, respectively provided on said jaw and a wall of said channel between said facing sides thereof, and cooperating with each other so as to precisely locate the jaw in the channel of the jaw assembly.

20. A removable jaw for a workpiece holder jaw assembly adapted to be secured to a plate, said jaw assembly including the removable jaw; a channel with a cutaway first side opposite to the plate and an angled send side facing said first side; a set screw adapted to releasably press said removable jaw against the angled second side and having an axis of rotation; and two bearing surfaces adapted to support the clamping force of said removable jaw, said removable jaw comprising:

a gripping surface adapted to apply clamping force to the workpiece;

a foot on a surface of the jaw opposite to said gripping surface, said foot being adapted to be received in the channel, said foot having a first angled surface adapted to be pressed against said angled second side of the channel, and a second angled surface, said first and second angled surfaces of the foot forming equal angles with said axis of rotation of said screw, whereby said removable jaw is pressed evenly against the two bearing surfaces; and locating means, respectively provided on said jaw and a wall of said channel between said facing sides thereof, and cooperating with each other so as to precisely locate the jaw in the channel of the jaw assembly.

21. A workpiece holder having a jaw assembly adapted to be secured to a plate, said jaw assembly comprising:

a channel having opposing sides, one side being substantially horizontal and the other side being angled and facing said one side;

a removable jaw including a griping surface adapted to apply a clamping force to a workpiece and a foot on a surface of the jaw opposite to said gripping surface, said foot being adapted to be received in said channel, said foot having an angled surface adapted to be pressed against said angled side of said channel;

means for releasably pressing said jaw against said angled side of the channel, whereby said removable jaw is releasably secured in said channel; and a tab, and a corresponding indentation, and wherein one of said jaw and said channel has an indentation adapted to receive said tab, so as to precisely locate the jaw in the channel on the jaw assembly.

22. A workpiece holder jaw assembly adapted to be secured to a plate, said jaw assembly comprising:

a channel having a cutaway first side opposite to the plate and an angled second side facing said first side;

a removable jaw including a gripping surface adapted to apply clamping force to the workpiece and a foot on a side of the jaw opposite to said gripping surface, said foot being adapted to be received in said channel, said foot having an angled surface adapted to be pressed against said angled second side of said channel;

means for releasably pressing said jaw against said angled second side of the channel, whereby said removable jaw is releasably secured in said channel;

a tab; and an indentation on said jaw adapted to receive said tab, so as to precisely locate the jaw in the channel on the jaw assembly.

23. A removable jaw for a workpiece holder jaw assembly, said jaw assembly being adapted to be secured to a plate; said jaw assembly including the removable jaw; a channel having a horizontal cutaway first side opposite to the plate and an angled second side facing said first side; and means for releasably pressing said jaw against said angled second side; said removable jaw comprising:

a gripping surface adapted to apply clamping force to the workpiece;

a foot on a surface of the jaw opposite to said gripping surface, said foot being adapted to be received in the channel, said foot having an angled surface adapted to be pressed against said angled second side of the channel, whereby said removable jaw is releasably secured in the channel of the jaw assembly; and an indentation on said jaw adapted to receive a tab located on the jaw assembly, so as to precisely locate said jaw in the channel of the jaw assembly.

* * * * *